US007152537B2

(12) United States Patent
Enault

(10) Patent No.: US 7,152,537 B2
(45) Date of Patent: Dec. 26, 2006

(54) FLUIDIZED BED BOILER FURNACE COMPRISING TWO HEARTHS SEPARATED BY AN INSIDE LEG AREA

(75) Inventor: Christian Enault, Fontenay-aux-Roses (FR)

(73) Assignee: ALSTOM (Switzerland) Ltd, Baden (CH)

( * ) Notice: Subject to any disclaimer, the term of this patent is extended or adjusted under 35 U.S.C. 154(b) by 0 days.

(21) Appl. No.: 10/508,798

(22) PCT Filed: Mar. 6, 2003

(86) PCT No.: PCT/FR03/00715

§ 371 (c)(1),
(2), (4) Date: Dec. 20, 2004

(87) PCT Pub. No.: WO03/081128

PCT Pub. Date: Oct. 2, 2003

(65) Prior Publication Data

US 2005/0092219 A1 May 5, 2005

(30) Foreign Application Priority Data

Mar. 25, 2002 (FR) ..... 02 03698

(51) Int. Cl.
*F23G 5/00* (2006.01)

(52) U.S. Cl. ..... 110/245; 122/235.15

(58) Field of Classification Search ..... 110/243, 110/244, 234, 245; 122/235.15
See application file for complete search history.

(56) References Cited

U.S. PATENT DOCUMENTS

| | | | | |
|---|---|---|---|---|
| 3,387,590 A * | 6/1968 | Bishop | 122/4 D |
| 3,893,426 A | 7/1975 | Bryers | |
| 4,184,455 A | 1/1980 | Talmud et al. | |
| 4,314,967 A * | 2/1982 | Kwon et al. | 422/49 |
| 6,532,905 B1 * | 3/2003 | Belin et al. | 122/4 D |

FOREIGN PATENT DOCUMENTS

| | | |
|---|---|---|
| EP | 0 477 849 A | 4/1992 |
| WO | WO 98 25074 A | 6/1998 |

* cited by examiner

*Primary Examiner*—Kenneth Rinehart
(74) *Attorney, Agent, or Firm*—Timothy J. Olson; Arthur E. Fournier, Jr.

(57) ABSTRACT

The fluidized bed boiler furnace having two hearths (2, 3) separated by a divider (1) in the bottom portion of the furnace comprises one or more panels (6) of heat exchange tubes each disposed vertically above the divider of the furnace and perpendicularly to the longitudinal direction (A) of said hearths.

4 Claims, 2 Drawing Sheets

FLUIDIZED BED BOILER FURNACE COMPRISING TWO HEARTHS SEPARATED BY AN INSIDE LEG AREA

BACKGROUND OF THE INVENTION

The invention relates to a fluidized bed furnace comprising two hearths separated by a divider in the bottom portion of the furnace, and at least one panel of heat exchange tubes.

A furnace of the above-described kind for a circulating fluidized bed boiler is known, in particular from patent applications FR-91/03700 and FR-90/11859. It is known to install one or more panels of heat exchange tubes carrying a heat-conveying fluid such as water or an emulsion of water and steam inside a furnace of a fluidized bed boiler. Each panel of tubes is conventionally disposed perpendicularly to the side walls of the furnace, and is optionally fixed thereto. Nevertheless, for a furnace comprising two hearths separated by a divider, such a disposition suffers from the drawback of limiting the number of panels that can be installed on the side walls of the furnace without impeding circulation of particles towards the cyclones provided on said side walls.

SUMMARY OF THE INVENTION

The object of the invention is to propose another disposition of heat exchange tube panels that takes advantage of the structure of a furnace having a divider in its bottom portion.

The furnace for a fluidized bed boiler of the invention is characterized in that the panel of tubes is disposed vertically above said divider and perpendicularly to the longitudinal direction of said hearths. In this way, load balancing within the furnace is not impeded. A plurality of panels may be disposed in a row on top of the divider, being spaced apart regularly from one another in said longitudinal direction so as to leave sufficient space for particle circulation without creating pressure unbalances inside the furnace.

In a particular embodiment of the panel of the invention, the tubes forming a panel extend tubes forming the divider, thereby avoiding the need to form feeds through the divider. A panel of the invention may also comprise alternating panels having tubes extending tubes forming the divider and panels having tubes which are connected to a manifold disposed within the divider. There will thus be panels fed by the fluid circulating in the walls of the furnace and panels fed with by the same fluid or with some other heat-conveying fluid.

Each panel of tubes is preferably fixed to the ceiling of the furnace so as to make it possible, if necessary, for the panel of tubes to be put under traction between the divider and the ceiling of the furnace so as to limit the vibration produced by the fluid circulating in the tubes of the panels.

BRIEF DESCRIPTION OF THE DRAWINGS

There follows a description by way of example and with reference to the diagrammatic FIGS. of the accompanying drawings of a furnace for a fluidized bed boiler of the invention.

DETAILED DESCRIPTION OF THE INVENTION

Figure 1:
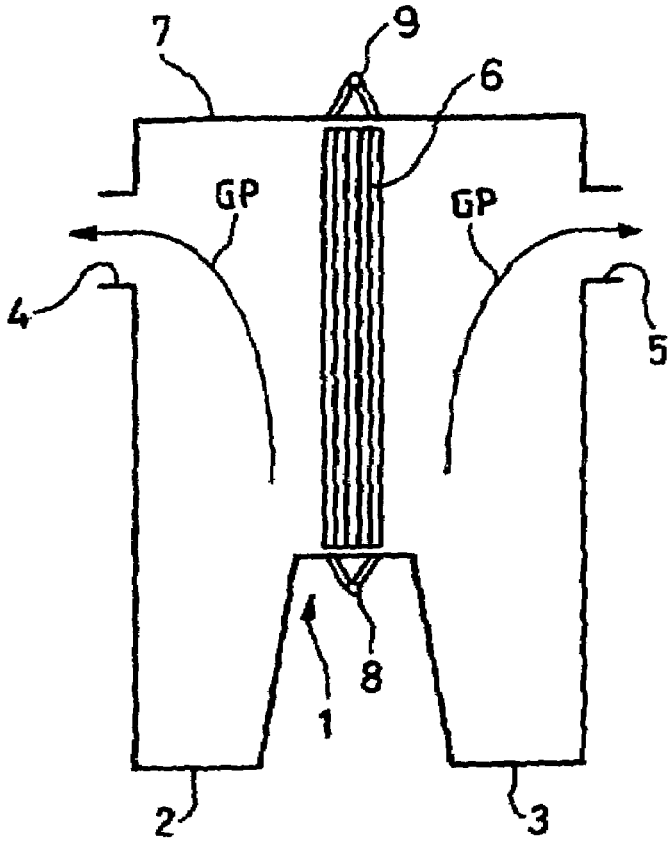
FIG. 1 is a very diagrammatic view of a furnace of the invention in longitudinal section showing a panel of tubes placed on the divider of the furnace.

The furnace shown in FIG. 1 is a furnace for a circulating fluidized bed (CFB) in which the bottom portion forms a divider 1 separating two hearths 2 and 3 of the furnace. The outlets from the furnace to cyclones are marked by references 4 and 5. The outlets to the cyclones are conventionally disposed on the side walls of the furnace, and a furnace having a divider may include four or more outlets to cyclones disposed on either side of the divider.

The furnace of the invention is fitted with at least one panel 6 of heat exchange tubes, which panel is disposed vertically on the top of the divider 1 and perpendicular to the longitudinal direction A of the hearths 2 and 3, so as to avoid impeding the circulation of gas and particles as represented by arrows GP, and so as to avoid setting up pressure unbalance within the furnace. Each panel 6 of heat exchange tubes is fixed to the ceiling 7 of the furnace and is put into traction between the ceiling and the divider to avoid unwanted vibration of the tubes in the panel when the furnace is in operation.

FIG. 1 shows an inlet manifold 8 placed within the divider 1 and an outlet manifold 9 placed above the ceiling 7 of the furnace, with the tubes of the panel 6 being connected to the manifold.

Figure 2:
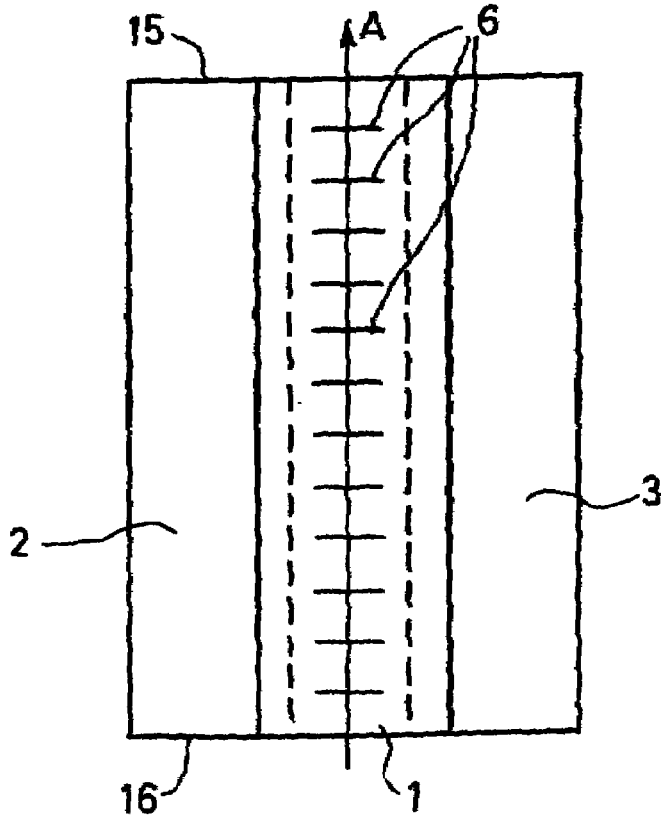
FIG. 2 is a highly diagrammatic plan view of the furnace showing the disposition of a plurality of panels of tubes on the divider of the furnace.

As can be seen in FIG. 2, a large number of panels 6 of tubes can be placed in a row on the top of the divider 1, being spaced apart regularly from one another along the divider 1.

Figure 3:
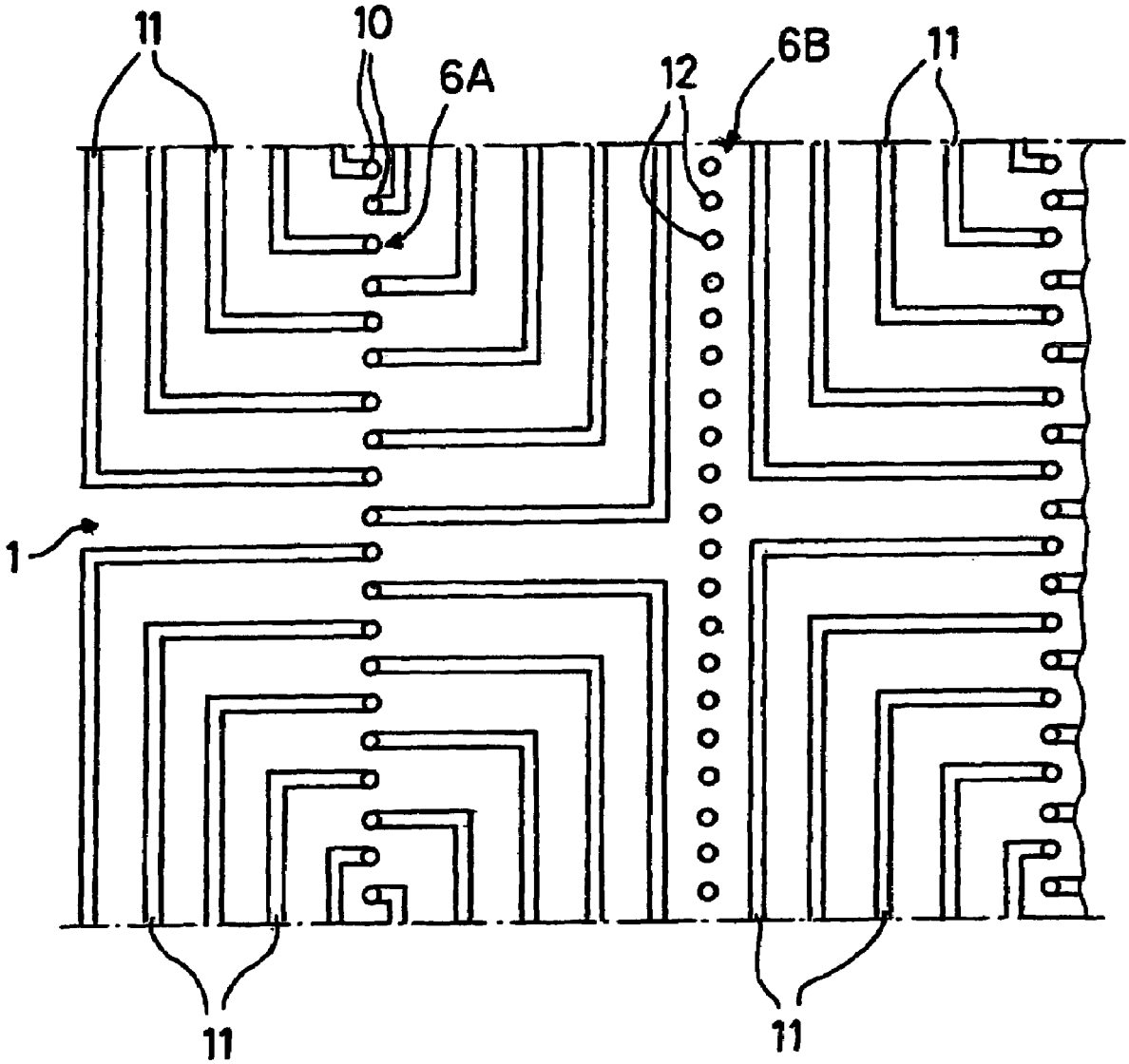
FIG. 3 is a highly diagrammatic view showing how a panel of tubes is formed with tubes forming the divider of the furnace.

The tubes forming the heat exchange panels 6 may extend tubes that form the divider of the furnace. It is also possible to have alternating panels 6 with tubes that extend tubes forming the divider of the furnace, and panels with tubes connected to the inlet manifold 8. FIG. 3 shows a panel 6A (seen from above) whose tubes 10 extend tubes 11 forming the divider 1, and a panel 6B (seen from above) whose tubes 12 are connected to the inlet manifold 8 (not shown). Naturally, the configuration of the tubes forming the divider 1 and shown in FIG. 3 is merely one non-limiting example of the invention. The disposition of the panels 6 of the invention is suitable both for a plane divider as shown in FIG. 1 and for a divider in the form of an upside-down V-shape. Furthermore, in the example shown, the outlets 4, 5 to the cyclones are situated in the side walls 13, 14; they could be situated in the transverse side walls 15 and 16.

The invention claimed is:

1. A fluidized bed boiler furnace comprising:

two hearths separated by a divider that extends upward from a bottom portion of the furnace, at least one panel of heat exchange tubes, and a ceiling, wherein the at least one panel of heat exchange tubes is disposed vertically above said divider and perpendicularly to the longitudinal direction of said two hearths such that the at least one panel of heat exchange tubes extends from a top of said divider towards said ceiling to which the at least one panel of heat exchange tubes is secured in such a manner that the at least one panel of heat exchange tubes is put into traction between said divider and said ceiling.

2. The fluidized bed boiler furnace of claim 1 comprising a row of the at least one panel of heat exchange tubes spaced regularly from one another along said longitudinal direction.

3. The fluidized bed boiler furnace of claim 1 in which the heat exchange tubes forming the at least one panel of heat exchange tubes extend from the heat exchange tubes forming said divider.

4. The fluidized bed boiler furnace of claim 1 comprising alternating panels whose heat exchange tubes extend from heat exchange tubes forming said divider, and panels whose heat exchange tubes are connected to a manifold disposed within said divider.

* * * * *